United States Patent [19]

Mailliet

[11] 4,135,705

[45] Jan. 23, 1979

[54] TAPHOLE SEALING APPARATUS

[75] Inventor: Pierre H. Mailliet, Howald, Luxembourg

[73] Assignee: S.A. des Anciens Etablissements Paul Wurth, Luxembourg

[21] Appl. No.: 829,211

[22] Filed: Aug. 31, 1977

Related U.S. Application Data

[63] Continuation-in-part of Ser. No. 705,680, Jul. 15, 1976, abandoned.

[30] Foreign Application Priority Data

Jul. 24, 1975 [LU] Luxembourg ..... 75045

[51] Int. Cl.[2] ..... C21B 7/12

[52] U.S. Cl. ..... 266/273

[58] Field of Search ..... 266/272, 273; 222/386, 222/389; 285/407, 411; 277/193

[56] References Cited

U.S. PATENT DOCUMENTS

| | | | |
|---|---|---|---|
| 144,802 | 11/1873 | Speak | 222/386 |
| 1,849,995 | 3/1932 | Schiegries | 266/273 |
| 1,852,560 | 4/1932 | Giese | 266/273 |
| 1,852,562 | 4/1932 | Giese | 266/273 |
| 1,889,433 | 11/1932 | Brosius | 266/273 |
| 1,985,544 | 12/1934 | Muchnic | 285/411 |
| 3,248,023 | 4/1966 | Dienenthal et al. | 222/389 |
| 3,984,091 | 10/1976 | Schneider | 266/273 |

*Primary Examiner*—Gerald A. Dost

[57] ABSTRACT

The servicing of clay guns used in plugging the pouring holes of blast furnaces is facilitated by providing for the access to the sealant receiving cylinders of such clay guns through the front end thereof and without disassembling the clay gun from their actuators. Ease of access results from providing a cylinder front end extension which may easily be removed from axial alignment with the cylinder and which receives and accommodates at least that portion of the clay gun ejector piston which bears sealing rings when the piston has been extended to its limit of travel.

12 Claims, 3 Drawing Figures

TAPHOLE SEALING APPARATUS

CROSS-REFERENCE TO RELATED APPLICATION

This application is a continuation-in-part of Application Ser. No. 705,680 filed July 15, 1976 and now abandoned. Application Serial No. 705,680 claimed the benefits of the filing date of Luxembourg Pat. No. 73,045 filed July 24, 1975 and the same priority is claimed for the common subject matter disclosed herein.

BACKGROUND OF THE INVENTION (1) Field of the Invention

The present invention relates to the plugging of tapholes in furnaces such as, for example, blast furnaces employed in the production of steel. More specifically, this invention is directed to an improved apparatus for use in the sealing of the pouring holes of a shaft furnace and particularly a furnace which operates with a high counter-pressure. Accordingly, the general objects of the present invention are to provide novel and improved methods and apparatus of such character.

(2) Description of the Prior Art

While not limited thereto in its utility, the present invention is particularly well suited for use in sealing the pouring holes of a shaft furnace. Such taphole plugging or sealing devices, because of the nature of the viscous material which is injected into the taphole for the purposes of closing the same, are known in the art as "clay guns" or "mud guns". For a general discussion of the operation of clay guns, reference may be had to U.S. Pat. No. 3,765,663 which is assigned to the assignee of the present invention. Reference may also be had to pending application Ser. No. 702,120, filed July 2, 1976 and entitled "IMPROVED CLAY GUN"; the pending application also being assigned to the assignee of the present invention.

The tapholes of modern shaft furnaces are plugged by injecting thereinto, at a very high pressure which is required as a consequence of the high counter-pressure within the furnaces, a sealing compound which generally consists of clay. Because of the requisite high pressure, the clay injecting mechanism or clay gun is coupled to a hydraulic jack which actuates an ejector piston within the clay gun. The clay ejector piston of the clay gun slides within a clay chamber and forces material, previously supplied to this chamber, through a "nose" which is inserted into the furnace pouring hole.

An ejector piston for a clay gun must be carefully designed and constructed taking into account the high operating pressures to which it will be subjected and the abrasive nature of the "clay" which must be moved thereby. A particularly stringent design requirement is that leakage of "clay" past the piston must, to the extent possible, be prevented in the interest of avoiding marring of the surface of the actuator piston rod. The harsh operating conditions, particularly the considerable strains imposed on the ejector piston of a clay gun, and the design requirements for this mechanism dictate that the ejector piston must be either replaced or repaired at regular intervals.

In accordance with previous clay gun designs, access to the ejector piston is possible only after the clay gun has been disassembled from the hydraulic actuator jack and the entire clay chamber dismantled. This is time consuming and thus, from the standpoint of both equipment down time and labor, an expensive procedure.

The operating environment, including the safety considerations incident to the plugging of a furnace taphole, requires that a clay gun be a highly reliable and rugged piece of equipment. Reliability and durability are, particularly considering the difficult working conditions, inconsistent with complexity. It is thus highly desirable, if not mandatory, that the ejector piston of a clay gun be operated to either of its limits of motion as determined by the hydraulic jack actuator, i.e., it is undesirable that there be any intermediate stop positions for the piston of the hydraulic jack actuator. In the prior art, in those cases where the nose portion of the clay gun barrel was removable for servicing, extension of the piston out of the thus opened barrel end could be accomplished only through provision of a complex control system wherein the normal full forward position of the ejector piston correspond to an intermediate stop position of the actuator. Thus, in order to move the ejector piston to a position more advanced than the forward termination of its normal stroke, a sophisticated control for the hydraulic system and a greater length for the hydraulic cylinder would be required. Both of these added requirements would increase the manufacturing cost of the clay gun, inherently increase its complexity and increase the size of a tool for which there is but limited installation space available.

In addition to the periodic repair or replacement of the clay gun ejector piston, it is to be noted that there is customarily a daily maintenance schedule wherein encrusted clay is removed from the cylinder or barrel forward of the ejector piston. It has been proposed to facilitate this daily maintenance by pivotally attaching the ejection nozzle to the clay gun barrel. An example of such a pivotally attached nozzle may be found in U.S. Pat. No. 1,889,433. A loose; i.e., a conventional pivot type connection; is only adequate if the movement of the clay ejector piston terminates short of the joint of the pivot connection. In view of the forces generated, any "play" between the elements to either side of the joint will result in axial or angular relative movement with the resultant creation of a rim on which the piston would hang up.

SUMMARY OF THE INVENTION

The present invention overcomes the above-briefly discussed and other deficiencies and disadvantages of the prior art through the provision of a novel clay chamber design which enables easy access to the ejector of a clay gun. The access afforded by the clay chamber design of the present invention enables segments of the ejector piston to be removed and replaced with minimum expenditure of time and without the necessity of detaching the clay gun from the hydraulic jack actuator.

The present invention achieves the above stated improvements in operation by extending the clay chamber of a taphole sealing device in the forward direction; i.e., in the direction of movement of the "clay" to be injected into a blast furnace pouring hole to be sealed. The clay chamber extension is designed so as to accommodate at least a portion of the clay gun ejector piston, which portion includes the sealing member or members carried by the piston, with the piston in its fully forward position. The clay chamber extension is rigidly mounted to the clay gun in such a manner that it, and the nose of the clay gun to which it is affixed, may be easily removed to thereby afford access to the thus opened end of the clay chamber and the ejector piston. The extension is, downstream of the portion thereof which receives the piston, convergent to direct the "clay" from the chamber to the nose of the clay gun.

In a first embodiment of the invention, the clay gun extension is of unitary construction and is connected to the end of the clay gun barrel in such a manner that, although removable, relative movement between the extension and barrel is precluded. In another embodiment of the invention the clay chamber extension is segmented and a nose or nozzle contacting portion thereof, located downstream in the direction of clay movement from the ejector piston accommodating portion, is pivotally mounted on the remainder of the extension whereby the daily maintenance operation can be achieved without removal of the entire clay chamber extension.

BRIEF DESCRIPTION OF THE DRAWING

The present invention may be better understood and its numerous objects and advantages will become apparent to those skilled in the art by reference to the accompanying drawing wherein like reference numerals refer to like elements in the various figures and in which.

DESCRIPTION OF THE PREFERRED EMBODIMENTS

Figure 1:
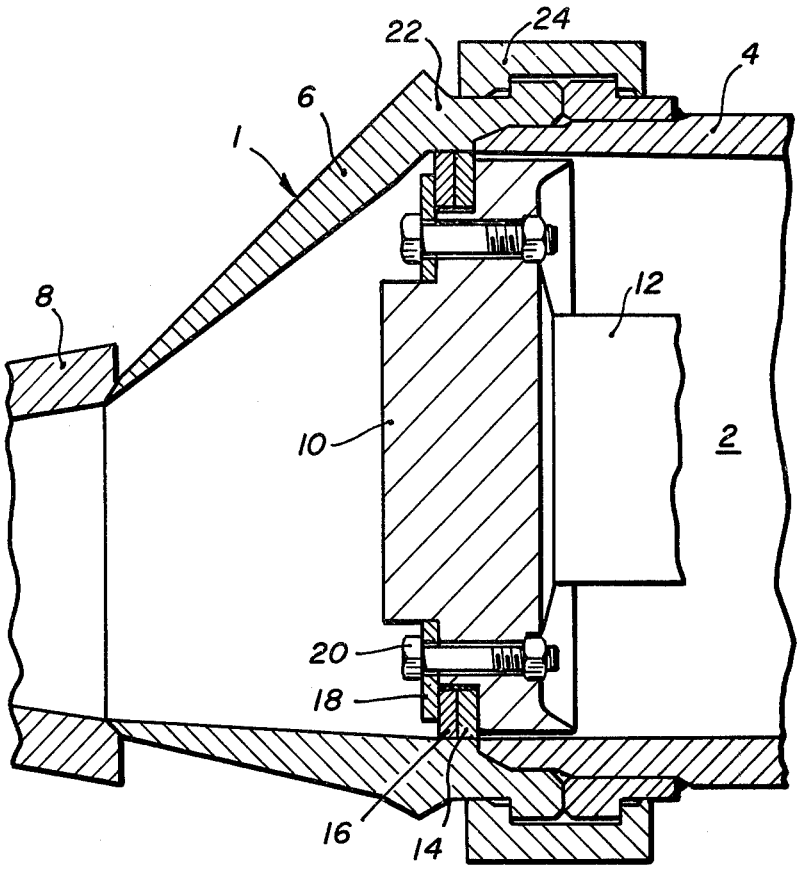
FIG. 1 is a partial cross-sectional side elevation view of a clay gun incorporating a first embodiment of the present invention.

With reference to FIG. 1, the forward or downstream end of a clay gun, in the direction of sealing compound movement, is indicated generally at 1. The clay gun 1 includes a clay receiving chamber 2. Clay chamber 2 is defined by a cylindrical member 4. The cylindrical member 4 is provided with an inlet port, not shown, through which the material which will be employed to seal the furnace pouring hole may be supplied to chamber 2. This inlet port will be positioned to the right of the termination of the partial view of the drawing and the sealing compound will be delivered to cylinder 2 via the inlet port when an ejector piston 10, which is shown in its fully extended position, is in its retracted position. The ejector piston 10 is operated by means of a hydraulic jack, not shown in FIG. 1 but indicated in FIG. 2 generally at 28, with the coupling between the hydraulic jack and ejector piston being effected by a piston rod 12.

Sealing compound or "clay" delivered to chamber 2 is, during a furnace taphole plugging operation, expelled from the chamber by being forced to the left, as the apparatus is shown in FIG. 1, by piston 10. During the taphole sealing operation the nose 8 of the clay gun will be engaged with the furnace taphole and, because of the high counter-pressure normally existing within modern operating blast furnaces, the clay must be forced through the nose 8 under a very high pressure as can be provided only by a hydraulic jack actuator.

As noted above, in the drawing the ejector piston 10 is shown in its fully forward position. Ejector piston 10 includes a pair of sealing members 14 and 16 which contact the wall of cylinder 2 to prevent the leakage of clay around piston 10. The sealing members 14 and 16 are held in position on a shoulder provided on the body of piston 10 by means of a locking ring 18. Locking ring 18 is secured, by means of bolts 20, to the body of piston 10. For the reasons discussed in referenced copending application Ser. No. 702,120, it is essential that leakage of the sealing compound, which contains highly abrasive particles, past piston 10 be prevented to the extent possible. The unintentional leakage of abrasive material onto the polished piston rod 12 could result in the marring of the surface of the piston rod with the resultant leakage of hydraulic fluid from the actuator jack.

The sealing members 14 and 16, because of the forces imposed thereon as a result of the high pressure against which the clay gun must operate and also because of the abrasive properties of the clay, are subjected to considerable strain and wear. Thus, in order for the requisite seaing about piston 10 to be maintained, members 14 and 16 must be periodically replaced. In the prior art the replacement of members 14 and 16 has required that the clay gun be disconnected from the hydraulic jack actuator and disassembled.

In accordance with the present invention the clay chamber defining member 4 is provided with an extension 6. Extension 6 has an upstream portion 22, which is preferably of cylindrical shape, adjacent the downstream or front end of the clay chamber and a generally converging downstream portion which extends from portion 22 to the clay gun nose 8. As will be described in greater detail below, when servicing of the ejector piston 10 is required, the piston 10 will be fully extended by means of the hydraulic actuator so that the sealing members 14 and 16 are accommodated in portion 22 of the clay chamber extension 6.

In order to facilitate the replacement of sealing members 14 and 16, as discussed above, these members are held in position on the piston by means of locking ring 18 and bolts 20. Accordingly, the sealing members 14 and 16 may be disengaged from piston 10 by means of a translatory movement in the axial direction subsequent to release of ring 18. Members 14 and 16 may thus be constructed in the form of completely closed rings. Due to the operating conditions to which the ejector piston is exposed, sealing members 14 and 16 cannot, however, be disengaged from the piston merely by releasing bolts 20. As a consequence of the nature of the clay and the exposure of the clay gun to the intense heat radiated from the furnace pouring channel, a crust of clay will form on the entire surface of piston 10 and this crust will extend into even the smallest interstices between the members 14 and 16. Thus, in order to unstick and release the sealing members 14 and 16, it is usually necessary to hammer on these members to fracture the encrustation of clay. The necessity of producing repetitive impacts on the piston in order to release sealing elements 14 and 16 requires that access to these sealing members in the radial direction be provided. As previously noted, in the prior art such radial access was obtained only by means of dismantling the entire clay chamber 2.

The extension 6 of the clay gun of the present invention is both coaxial with the clay chamber defining member 4 and detachable therefrom. To maintain this mandatory coaxial relationship, extension 6 is firmly and rigidly affixed to chamber defining member 4 by means of a collar 24; collar 24 being releasable via conventional means, not shown. The nose 8 will be rigidly attached to extension 6 and the combination of the nose 8 and extension 6 will preferably be connected to chamber defining member 4 by means of a hinge, not shown, whereby the extension 6 and nose 8 may be pivoted about a vertical axis subsequent to removal of collar 24. The front of the clay chamber can thus be completely opened and, since the sealing members 14 and 16 are disposed within the region normally circumscribed by portion 22 of extension 6, the entire front face of ejector piston 10 and the sides of the sealing members 14 and 16 will be exposed when extension 6 has been moved to the open position and piston 10 actuated to its fully forward position. The accurate mechanical connection between extension 6 and chamber 4 established by removable collar 24 precludes any relative movement between these elements and thus insures against the piston binding or leakage of clay around the piston 10.

The present invention also facilitates the replacement of the entire ejector piston 10. The ejector piston is generally attached to piston rod 12 by means of bolts and access to these bolts is provided in the same manner as described above with respect to bolts 20 and sealing rings 14 and 16.

A further advantage of the present invention resides in the fact that it facilitates cleaning of the clay chamber 2. Thus, with extension 6 either removed from or pivoted about a vertical axis with respect to chamber defining member 4, and with the piston 10 in its retracted position, both the interior of clay chamber 2 and the interior of extension 6 may be cleaned.

In the interest of avoiding the jamming or binding of the sealing rings 14 and 16 at the junction of the clay chamber defining cylindrical member 4 and the upstream portion 22 of extension 6, the wall of cylinder defining member 4 may be caused to be slightly divergent adjacent to cylindrical portion 22 of extension 6. The re-entry of the sealing rings 14 and 16 from portion 22 of extension 6 into chamber 2 may also be facilitated by providing the sealing rings with rounded edges.

Figure 3:
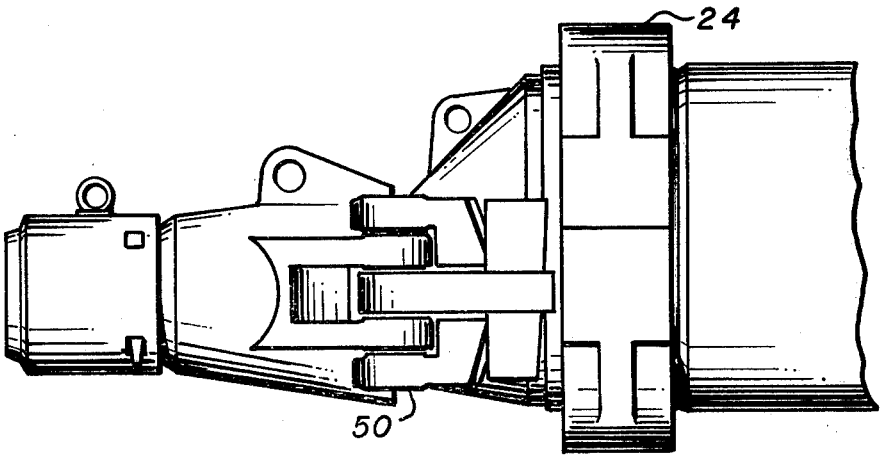
FIG. 3 is a side view, on an enlarged scale, of the clay chamber extension of the clay gun of FIG. 2.
Figure 2:
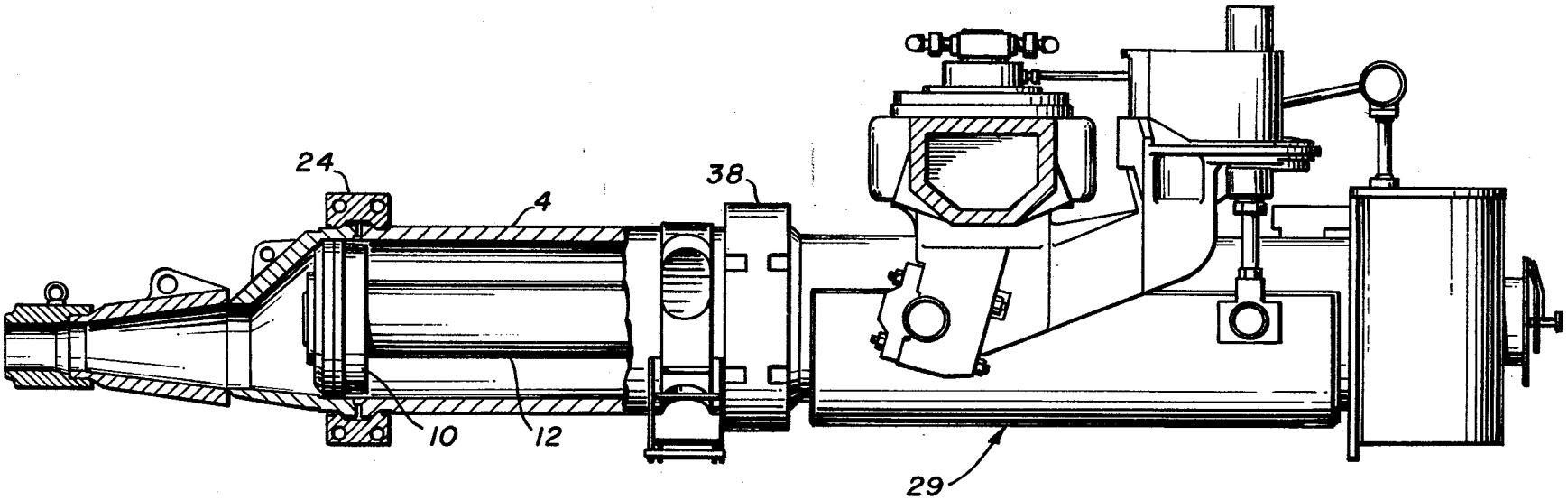
FIG. 2 is a side elevation view, partially in section, of a clay gun in accordance with a second embodiment of the present invention.

Referring now jointly to FIGS. 2 and 3, a second embodiment of the present invention is disclosed. The principal difference between the embodiment of FIGS. 2 and 3 and that of FIG. 1 is that in the device of FIGS. 2 and 3 the clay chamber extension is segmented so as to define an ejector piston receiving intermediate cone 30 and a downstream nozzle attaching member 31. A nozzle extension 32 is received on the downstream end of nozzle attaching member 31. The intermediate cone member 30 has a tapering portion, which communicates at its narrow downstream end with member 31, and a cylindrical upstream portion which receives the ejector piston 10 as shown. Piston 10, of course, travels within a clay chamber or barrel defining cylindrical member 4 and is attached to a piston rod 12 which extends into the clay chamber from the hydraulic jack actuator 29.

The clay chamber extension, and particularly the intermediate cone member 30 thereof, is rigidly but removably attached to the downstream end of the cylinder defining member 4 by means of a collar 24. Collar 24 may be in the form of a split coupling as shown.

The intermediate cone member 30 and nozzle attaching member 31 are connected together by means of a hinge connection 50; the hinge connection including suitable latches.

To briefly describe the actuating mechanism as depicted in FIG. 2, the hydraulic jack 29 includes a cylinder in which an actuator piston moves. An adjustment mechanism 34 is provided to permit vertical adjustment of the clay gun. An indicator 36 is provided for indicating the position of the piston within the actuator 29 and thus also the position of the ejector piston in the clay chamber. The hydraulic actuator 29 is connected to the clay gun barrel defining member 4 by means of a further split coupling 38.

While preferred embodiments have been shown and described, various modifications and substitutions may be made thereto without departing from the spirit and scope of the invention. Thus, by way of example, piston 10 may be provided with any desired number of sealing rings and these sealing members may be continuous or discontinuous and elastic or rigid as required by the operating conditions. Accordingly, it will be understood that the present invention has been described by way of illustration and not limitation.

What is claimed is:

1. In apparatus for closing tapholes in a blast furnace by means of injection of a sealing compound into such holes, the taphole closing apparatus being intended for operation by a hydraulic actuator having two operative states respectively commensurate with the actuator piston being fully extended and fully retracted, the improvement comprising:

means defining a taphole sealing compound receiving cylinder, the sealing compound receiving cylinder having first and second oppositely disposed ends;

ejector piston means disposed for movement within said sealing compound receiving cylinder only between first and second positions, said piston means including a piston and at least a first peripheral sealing member mounted thereon, said first sealing member cooperating with the inside of said cylinder to prevent leakage of sealing compound past the piston;

piston rod means extending into said sealing compound receiving cylinder through the first end thereof, said rod means coupling said ejector piston means piston to the actuator piston whereby the actuator controls the movements of said ejector piston means piston between said first and second positions;

a tubular taphole engaging nose through which the sealing compound is expelled from the apparatus;

tubular cylinder extension means for providing fluid communication between said sealing compound receiving cylinder defining means second end and said nose, said extension means including a first portion dimensioned so as to receive at least a portion of said ejector piston means including the first sealing member mounted thereon, the first position of said piston means piston corresponding to the actuator piston being in its fully extended position and placing said portion of said piston means piston within said extension means, at least a portion of the sealing member being located in the extension means when the piston means is in the first position, whereby removal of said extension means from said cylinder defining means affords unobstructed access in the radial direction to said piston means for servicing thereof with said piston means actuated to said first position, said extension means also including a second portion which defines a passage extending from said first portion to said nose; and collar means, said collar means engaging the exterior of said sealing compound receiving cylinder defining means and said extension means to rigidly and detachably hold said extension means with the first portion thereof in axial alignment with said cylinder defining means cylinder.

2. The apparatus of claim 1 further comprising:

hinge means pivotally mounting said extension means second portion from said extension means first portion.

3. The apparatus of claim 1 wherein said collar means comprises:

a split coupling, said coupling engaging the exterior of each of said extension means and said cylinder defining means.

4. The apparatus of claim 2 wherein said tubular extension means first portion includes:

an upstream cylindrical section; and a downstream section which converges in the direction of sealing compound movement from said cylindrical section, said converging downstream section communicating, at its smaller diameter end, with said extension means second portion.

5. The apparatus of claim 4 wherein said extension means second portion defines a passage which converges in the downstream direction from said extension means first portion convergent section and said nose.

6. The apparatus of claim 5 wherein said collar means comprises:

a split coupling, said coupling engaging the exterior of each of said extension means and said cylinder defining means.

7. The apparatus of claim 1 wherein said piston means further comprises:

at least a second sealing member mounted on the periphery of said piston; and retainer means removably affixed to the face of said piston which contacts the sealing compound in the cylinder, said retainer means holding said sealing members in position on said piston means.

8. The apparatus of claim 4 wherein said piston means further comprises:

at least a second sealing member mounted on the periphery of said piston; and retainer means removably affixed to the face of said piston which contacts the sealing compound in the cylinder, said retainer means holding said sealing members in position on said piston means.

9. The apparatus of claim 8 wherein said retainer means includes:

a locking ring; and a plurality of fasteners, said fasteners engaging said locking ring and said piston.

10. In apparatus for closing tapholes in a blast furnace by means of injection of a sealing compound into such holes, the taphole closing apparatus being intended for operation by a hyraulic actuator having two operative states respectively commensurate with the actuator piston being fully extended and fully retracted, the improvement comprising:

means defining a taphole sealing compound receiving cylinder, the sealing compound receiving cylinder having first and second oppositely disposed ends;

ejector piston means disposed for movement within said sealing compound receiving cylinder, said piston means including a piston;

a first peripheral sealing member mounted on said ejector piston means piston, said first sealing member cooperating with the inside of said cylinder to prevent leakage of sealing compound past said piston means piston;

at least a second peripheral sealing member mounted on said ejector piston means piston, said second sealing member cooperating with the inside of said cylinder to prevent leakage of sealing compound past the piston;

removable retainer means for holding said sealing members on said ejector piston means piston;

piston rod means extending into said sealing compound receiving cylinder through the first end thereof, said rod means coupling said ejector piston means piston to the actuator piston whereby the actuator controls the movements of said ejector piston means piston between said first and second positions;

a tubular taphole engaging nose through which the sealing compound is expelled from the apparatus;

tubular cylinder extension means for providing fluid communication between said sealing compound receiving cylinder defining means second end and said nose, said extension means including a first portion dimensioned so as to receive at least a portion of said ejector piston means including the first sealing member mounted thereon, the first position of said piston means piston corresponding to the actuator piston being in its fully extended position and placing said portion of said piston means piston within said extension means, at least a portion of one of the sealing members being located in the extension means when the piston means is in the first position, whereby removal of said extension means from said cylinder defining means affords unobstructed access in the radial direction to said piston means for servicing thereof with said piston means actuated to said first position, said extension means also including a second portion which defines a passage extending from said first portion to said nose; and collar means, said collar means engaging the exterior of said sealing compound receiving cylinder defining means and said extension means to rigidly and detachably hold said extension means with the first portion thereof in axial alignment with said cylinder defining means cylinder.

11. The apparatus of claim 10 wherein said cylinder extension means comprises:

a cylindrical first section which receives said ejector piston portion;

a diverging second section integral with said first section, said first and second sections cooperating to define said extension means first portion;

a tubular member, said tubular member diverging at a lesser rate than said second section and providing communication between said second section and said nose; and hinge means mounting said tubular member on said second section.

12. In apparatus for closing tapholes in a blast furnace by means of injection of a sealing compound into such holes, the taphole closing apparatus being intended for operation by a hydraulic actuator having two operative states respectively commensurate with the actuator piston being fully extended and fully retracted, the improvement comprising:

means defining a taphole sealing compound receiving cylinder, the sealing compound receiving cylinder having first and second oppositely disposed ends, said cylinder further having a divergent portion extending inwardly from the second end thereof, said divergent portion having a maximum diameter at the second end of the cylinder;

ejector piston means disposed for movement within said sealing compound receiving cylinder only between first and second positions, said piston means including a piston and at least a first peripheral sealing member mounted thereon, said first sealing member cooperating with the inside of said cylinder to prevent leakage of sealing compound past the piston;

piston rod means extending into said sealing compound receiving cylinder through the first end thereof, said rod means coupling said ejector piston means piston to the actuator piston whereby the actuator controls the movements of said ejector piston means piston between said first and second positions;

a tubular taphole engaging nose through which the sealing compound is expelled from the apparatus;

tubular cylinder extension means for providing fluid communication between said sealing compound receiving cylinder defining means second end and said nose, said extension means including a first portion dimensioned so as to receive at least a portion of said ejector piston means piston including the first sealing member mounted thereon, the first position of said piston means piston corresponding to the actuator piston being in its fully extended position and placing said portion of said piston means piston within said extension means whereby removal of said extension means from said cylinder defining means affords unobstructed access in the radial direction to said piston means for servicing thereof with said piston means actuated to said first position, said extension means also including a second portion which defines a passage extending from said first portion to said nose; and collar means, said collar means engaging the exterior of said sealing compound receiving cylinder defining means and said extension means first portion to rigidly and detachably hold said extension means with the first portion thereof in axial alignment with said cylinder defining means cylinder.

* * * * *